United States Patent [19]

Baker et al.

[11] Patent Number: 4,529,626

[45] Date of Patent: Jul. 16, 1985

[54] INHIBITION OF CARBON ACCUMULATION ON METAL SURFACES

[75] Inventors: Rees T. Baker, Annandale; James J. Chludzinski, Rahway, both of N.J.; James A. Dumesic, Madison, Wis.

[73] Assignee: Exxon Research and Engineering Co., Florham Park, N.J.

[21] Appl. No.: 635,196

[22] Filed: Jul. 27, 1984

[51] Int. Cl.[3] ..... B05D 3/02; C23C 11/00

[52] U.S. Cl. ..... 427/226; 148/6.3; 148/6.35; 427/249; 427/376.4; 427/376.5; 427/419.2

[58] Field of Search ..... 427/226, 228, 249, 419.2, 427/419.7, 376.4, 376.5; 148/6.3, 6.35

[56] References Cited

U.S. PATENT DOCUMENTS

| | | | |
|---|---|---|---|
| 3,676,179 | 7/1972 | Bokros | 427/249 X |
| 4,162,345 | 7/1979 | Holzl | 427/295 X |
| 4,343,658 | 8/1982 | Baker et al. | 427/249 X |

*Primary Examiner*—Michael R. Lusignan

*Attorney, Agent, or Firm*—Henry E. Naylor

[57] ABSTRACT

Disclosed herein is a method for protecting a metal surface against carbon accumulation wherein the metal surface is one which is susceptible to carbon accumulation when exposed to an environment in which carbon-containing gases are undergoing decomposition which method comprises providing a coating on the metal surface which coating is comprised of a metal oxide selected from the group consisting of $Ti_4O_7$, $NbO_2$, and VO.

8 Claims, No Drawings

INHIBITION OF CARBON ACCUMULATION ON METAL SURFACES

FIELD OF THE INVENTION

The present invention relates to the inhibition of the accumulation of carbon on metal surfaces which are subjected to an environment in which the decomposition of carbon-containing gases is occuring. This is accomplished by coating the metal surfaces with one or more precursor compounds capable of being reduced to one or more of the oxides selected from the group consisting of $Ti_4O_7$, $NbO_2$, and VO. Preferably, the precursor compounds are metal oxides selected from $TiO_2$, $Nb_2O_5$, and $V_2O_3$. Reduction is accomplished by heating the treated metal surface at a temperature of at least about 400° C. in a hydrogen containing reducing environment.

BACKGROUND OF THE INVENTION

Metal surfaces, especially those containing iron, nickel, chromium, cobalt, molybdenum, and alloys and combinations thereof, are prone to the accumulation of both filamentous and amorphous carbon when subjected to high temperature reactions involving carbon-containing materials, e.g., hydrocarbons and carbon monoxide. Examples of such reactions, which are of commercial importance, are the production of ethylene by cracking, the production of motor fuels from petroleum sources by conversion of heavy feedstocks, the production of vinyl chloride from dichloroethane, and the production of CO and $H_2$ by steam reforming of hydrocarbon feed stock over a nickel-supported catalyst. Such reactions are generally accompanied by the accumulation of carbon on the surfaces of the reaction tubes in contact with the reaction medium. This accumulation of carbon in the reaction tubes causes a restricted flow of the reaction material and reduced heat transfer from the reaction tube to the reaction medium. It also causes damage to the inner surface of the tube owing to carburization. Frequent exposure to a carburization/oxidation cycle also accelerates corrosion, both of which reduce reactor tube life expectancy. The reduction in heat transfer necessitates raising the reaction tube temperature to maintain a constant gas temperature and production rate, thereby further decreasing the life expectancy of the tube.

Various methods have been employed to inhibit the accumulation of carbon. Such methods include steam pretreatment of the inner surface of the reactor tube to promote formation of a protective oxide film. Also, sulfur compounds are added to the process gases to poison active nickel sites and to scavenge free radical precursors of amorphous carbon. However, the rate of carbon accumulation can still be rapid under high severity conditions.

Other methods include the process taught in U.S. Pat. No. 4,099,990 for forming protection films on nickel, chromium or iron alloy substrates susceptible to coke formation. This process consists of first preoxidizing the substrate surface, then depositing thereon a layer of silica by thermally decomposing an alkoxysilane vapor.

Another method is disclosed in U.K. Pat. No. 1,529,441 wherein protective films are formed on a substrate of an iron, nickel, chromium, or alloy thereof. The protective film is applied by first depositing on the substrate surface a layer of another metal such as aluminum, iron, chromium or molybdenum by vaporization and then forming a protective oxide layer by treatment with steam or oxygen.

Heat-exchangers in nuclear reactors can be protected against carbon deposits by use of certain volatile silicon compounds such as dichlorodiethylsilane. See U.S. Pat. No. 3,560,336.

Yet another method is taught in U.S. Pat. No. 4,343,658 wherein a metal surface is first treated with tungsten, tantalum or a compound which will decompose to form tungsten, tantalum, or an oxide thereof, then subjected to a heat treatment at a temperature from about 600° C. to about 1200° C.

Although many of these methods have met with varying degrees of success, there is still a need in the art for developing alternative methods and compositions for protecting such surfaces. For example, although $Al_2O_3$, $TiO_2$, and $SiO_2$ are widely used for protecting metal surfaces from carbon accumulation, they suffer from the disadvantage of spalling-off the metal surface at high temperatures, thereby exposing such surfaces to attack.

SUMMARY OF THE INVENTION

In accordance with the present invention carbon accumulation is inhibited on metal surfaces which are exposed to an environment wherein carbon-containing gases are decomposing by providing a coating on the metal surface of one or more metal oxides selected from the group consisting of $Ti_4O_7$, $NbO_2$, and VO.

A preferred method for treating the metal surface comprises: (a) depositing on the metal surface one or more precursor compounds capable of being reduced to one or more metal oxides selected from the group consisting of $Ti_4O_7$, $NbO_2$, and VO, and (b) heating the so deposited metal surface to a temperature of about 400° C. to the decomposition temperature of the oxide, in a reducing environment containing hydrogen, for an effective period of time, thereby allowing the resulting reduced oxides to spread over the surface of the metal.

In preferred embodiments of the present invention the precursor compound is a metal oxide selected from $TiO_2$, $Nb_2O_5$, and $V_2O_3$, and the treated metal surface is heated in hydrogen to a temperature from about 500° C. to about 800° C. In still other preferred embodiments, the metal surface is of a metal selected from the group consisting of iron, nickel, chromium, cobalt, molybdenum, and alloys thereof.

DETAILED DESCRIPTION OF THE INVENTION

Metal surfaces containing iron, nickel, chromium, cobalt, molybdenum, and alloys and combinations thereof, are subject to carbon accumulation when exposed to environments in which carbon-containing gases are decomposing. This accumulated carbon is generally composed of filamentous carbon, as well as amorphous carbon. Although not wishing to be limited by theory, it is believed that the carbon filaments are formed by the metal catalyzed decomposition of carbon-containing gas. It is believed that carbon diffuses through the metal particle from the hotter leading face on which the decomposition of the carbon-containing material occurs to the cooling trailing faces at which carbon is deposited from solution. Carbon remaining at the leading particle surface diffuses around the particles to constitute the wall of the filament. It is believed filament growth ceases when the leading face is covered with a layer of carbon built up as a consequence of rate control by the carbon diffusion process. In other words, particles of metal such as iron and nickel, originating from the metal substrate, catalyze the formation of filamentous carbon. The filamentous carbon provides a large surface area for the collection of amorphous carbon which fills the voids between filaments, thereby producing a compact carbon structure. Therefore, if the growth of filamentous carbon can be inhibited, the build-up of amorphous carbon can be reduced, thereby substantially reducing the total carbon accumulation on the metal surface exposed to the decomposition of carbon-containing gases.

Non-limiting examples of metal alloys which can be protected by the present invention include alloys such as mild steel as well as high and low alloy steels. Especially included are the alloys or superalloys used (a) in tubular reactors for the conversion of hydrocarbons and the production of vinyl chloride from dichloroethane, and (b) in heat exchangers in modern gas-cooled reactors, such as nuclear reactors. Such alloys are ordinarily based on iron, nickel, and contain significant amounts of chromium. Examples of commercially available alloys which can be protected by use of the present invention include the high-alloy steels sold under the names Inconel, Incoloy, and AISI3IO/HK 40 steel. Other stainless steels of lesser quality, such as alloys of 321, 304 and 316 types, can also be protected by use of the present invention.

All three of the reduced oxides $Ti_4O_7$, $NbO_2$, and VO, which are non-stoichiometric, are characterized as having a high interfacial energy and consequently it would be expected that all three would have a tendency to spread on metal surfaces at elevated temperatures.

The inventors hereof have surprisingly discovered that the reduced oxides $Ti_4O_7$, $NbO_2$, and VO are capable of wetting and spreading across metal surfaces to form an adherent coating protective against carbon accumulation. These reduced oxide coatings differ from conventional oxide coatings such as $Al_2O_3$, $SiO_2$, and $TiO_2$ in that they form a strong chemical bond with the metal surface and consequently are not subject to spalling at high temperatures. Metal surfaces so treated can then be subjected to environments in which carbon-containing gases are decomposing with the result that carbon accumulation on these coated surfaces will be substantially inhibited.

In general, the present invention is practiced by first depositing on the metal surface to be protected one or more precursor compounds capable of being reduced with hydrogen at temperatures greater than about 400° C. to one or more of the reduced oxides $Ti_4O_7$, $NbO_2$ or VO. The precursor compounds are preferably metal oxides and are preferably applied to the metal surface in powder form. Preferred metal oxide precursors are $TiO_2$, $Nb_2O_5$ and $V_2O_3$. The precursor compound will preferably be dispersed in a liquid carrier, or dispersant, such as an organic solvent, for example, alcohols, ketones, ethers, etc.

Non-limiting methods for applying the precursor compound include chemical vapor deposition, spraying, and laser plasma techniques. Preferred is spraying in combination with a liquid carrier.

After the metal surface is treated with the precursor compound, it is heated to a temperature from about 400° C. to the decomposition temperature of the precursor in a reducing atmosphere wherein the reducing agent is hydrogen. Preferably, the temperature will range from about 400° C. to about 1000° C., more preferably from about 500° C. to about 800° C. The heated metal surface is subjected to the heat treatment for an effective amount of time. That is, for at least that amount of time which will allow the resulting reduced oxides to spread across the entire surface of the metal, thereby forming an adherent coating protecting substantially the entire metal surface against carbon acumulation. The precursor compound in its initial state is not capable of wetting the metal surface. Following reduction, the interfacial energy of the reduced oxides ($Ti_4O_7$, $NbO_2$ and VO) increases to a sufficiently high value so as to provide a driving force for the spreading of reduced oxide species across the metal surface.

The amount of accumulated carbon on the surface of the substrate can be determined by any conventional method used for such purposes and is within the scope of those having ordinary skill in the art. Examples of such conventional methods include simply measuring the increase in weight of the substrate after exposure to a carbon-decompositing environment or by reacting the accumulated carbon with oxygen at about 650° C., thereby converting the carbon to carbon dioxide, which can then be readily measured.

The following examples serve to more fully describe the manner of making and using the above-described invention, as well as to set forth the best modes contemplated for carrying out various aspects of the invention. It is understood that these examples in no way serve to limit the true scope of this invention, but rather, are presented for illustrative purposes.

The microscopy experiments described herein were performed in a controlled atmosphere electron microscope. The nickel specimens were in the form of electron microscopy grids, which were first degreased in acetone and then washed in deionized water, then spot welded across the specimen hole in a platinum heater ribbon. The titanium oxide ($TiO_2$) in powder form was introduced onto the nickel grids by the following procedure: the oxide powder was ultrasonically dispersed in n-butanol and a portion of the resulting mixture was applied to the grid as an atomized spray and then allowed to dry in air.

Although these specimens were too thick to allow penetration by a 100 kev electron beam, it was possible to follow the reactions occurring at the edges by observing the changes in shape of the silohette as a function to time and temperature.

The gases used were hydrogen, oxygen, and acetylene, and were about 99.5% pure.

The flow experiments were carried in a quartz U-tube, 40 cm in total length with one arm being 12 mm diameter and the other, 4 mm. Specimens in the form of foils (0.01 cm thick, and cut into rectangles (3.5 cm×0.6 cm), were loaded into the wider portion of the tube. The reactor tube was then placed in a Thermolyne® "mini-melt" furnace, the temperature of which was measured by a Pt/Pt 13% Rh thermocouple connected to a heat controller unit. One end of the U-tube was attached to an ethane cylinder via a flow controller, while the other end was connected via a variable leak valve to a UTI-mass spectrometer, model 100C. With this arrangement it was possible to sample the gas phase products at regular intervals during the reaction. Prior to each run a fresh sample of nickel foil (Material Research Corp. Orangeburn, NY, marz grade) was degreased in acetone, washed in deionized water, and dried. Samples where the effects of titanium oxide additions were being investigated were prepared by spraying both sides of the foil with the same mixture as that used to prepare the electron microscopy specimens. The coated specimens were allowed to dry, subsequently weighed, and placed in the reactor tube. The apparatus was evacuated to $10^{-4}$ Torr and heated to the desired reaction temperature in the presence of argon. The argon was replaced by ethane (C.P. grade) at a flow rate of 50 sccm, and allowed to react for 1.0 hour. In experiments for Example 3 this procedure was modified to include a reduction step before the hydrocarbon treatment. This involved heating the sample to 600° C. for 1.0 hour in a flowing 10% hydrogen/argon mixture. Hydrogen was subsequently removed from the reactor tube by flushing with argon at room temperature for 1.0 hour, and then the sample was reacted in ethane in the manner described above. Reactions were performed at 600° C., 700°, and 800° using three types of samples; pure nickel, nickel with titanium oxide, and nickel with reduced titanium oxide. Following reaction in ethane, the samples were cooled and reweighed. The weight of carbon deposited on a given sample was determined from the weight difference and is expressed as grams of carbon per $cm^2$ of nickel.

The results of these experiments are found in Table I below.

TABLE I

| Example | Treatment | Weight of Carbon Deposited (g × 10/cm²) | | |
|---|---|---|---|---|
| | | 600° C. | 700° C. | 800° C. |
| Example 1 (comparative) | Virgin Nickel | 1.9 | 26.2 | 27.7 |
| Example 2 (comparative) | Nickel/$TiO_2$ | 0.2 | 24.5 | 25.0 |
| Example 3 | Nickel/$Ti_4O_7$ | 0.2 | 10.0 | 6.4 |

What is claimed is:

1. A method for protecting a metal surface against carbon accumulation wherein the metal surface is one which is susceptible to carbon accumulation when exposed to an environment in which carbon-containing gases are undergoing decomposition which method comprises providing a coating on the metal surface which coating is comprised of a metal oxide selected from the group consisting of $Ti_4O_7$, $NbO_2$, and VO.

2. The method of claim 1 wherein the metal is an iron, nickel, or cobalt based alloy.

3. A method for protecting a metal surface against carbon accumulation wherein the metal surface is one which is susceptible to carbon accumulation when exposed to an environment in which carbon-containing gases are undergoing decomposition which method comprises:

(a) depositing on the metal surface at least one precursor compound which upon reduction in accordance with step (b) below will form one or more of the reduced metal oxides $Ti_4O_7$, $NbO_2$, and VO; and (b) heating the metal surface containing the precursor to a temperature from about 400° C. to about the temperature at which the resulting protective oxide decomposes, in a reducing environment wherein the reducing agent is hydrogen, and for an effective amount of time, thereby causing the resulting one or more reduced oxides to wet and spread over substantially the entire surface of the metal.

4. The method of claim 3 wherein the precursor compound is a metal oxide selected from the group consisting of $TiO_2$, $Nb_2O_5$, and $V_2O_3$.

5. The method of claim 4 wherein the metal is an iron, nickel, or cobalt, molybdenum based alloy.

6. The method of claim 5 wherein the metal is an iron or nickel based alloy.

7. The method of claim 5 wherein the precursor is reduced at a temperature from about 500° C. to about 800° C.

8. The method of claim 4 wherein the metal oxide precursor is mixed with an organic liquid carrier selected from the group consisting of alcohols, ketones, and ethers and sprayed onto the metal surfaces to be protected.

* * * * *